US011230815B2

(12) United States Patent
Johnson et al.

(10) Patent No.: US 11,230,815 B2
(45) Date of Patent: Jan. 25, 2022

(54) DOWEL BASKET WITH NON-METALLIC DOWEL BARS AND METHOD OF MAKING SAME

(71) Applicant: SAEL, LLC., McMurray, PA (US)

(72) Inventors: Chad Johnson, Stockdale, PA (US); Monica Parker, Elizabeth, PA (US); Katey Doman, Allenport, PA (US); Daniel Lucas, McMurray, PA (US)

(73) Assignee: SAEL, LLC., McMurray, PA (US)

( * ) Notice: Subject to any disclaimer, the term of this patent is extended or adjusted under 35 U.S.C. 154(b) by 157 days.

(21) Appl. No.: 16/737,062

(22) Filed: Jan. 8, 2020

(65) Prior Publication Data

US 2020/0217022 A1 Jul. 9, 2020

Related U.S. Application Data

(60) Provisional application No. 62/789,859, filed on Jan. 8, 2019.

(51) Int. Cl.
*E01C 11/00* (2006.01)
*E01C 11/14* (2006.01)
*E01C 11/06* (2006.01)

(52) U.S. Cl.
CPC ..... *E01C 11/14* (2013.01); *E01C 11/06* (2013.01)

(58) Field of Classification Search
CPC ..... E01C 11/06; E01C 11/14
USPC ..... 404/46–72, 134–136
See application file for complete search history.

(56) References Cited

U.S. PATENT DOCUMENTS 2,163,397 A * 6/1939 Friberg ..... E01C 11/14 404/63
2,448,134 A * 8/1948 Abel ..... E01C 5/005 404/63
2,552,365 A 5/1951 Bradbury
2,627,793 A 2/1953 White
2,768,562 A 10/1956 Godwin
2,829,572 A 4/1958 Vanek
2,834,266 A * 5/1958 Brickman ..... E01C 11/14 404/63
3,033,087 A * 5/1962 Hillberg ..... E01C 11/14 404/62
3,045,564 A 7/1962 Crone
3,059,553 A 10/1962 Woolley
3,114,221 A 12/1963 Eriksson
(Continued)

*Primary Examiner* — Raymond W Addie
(74) *Attorney, Agent, or Firm* — Blynn L. Shideler; Krisanne Shideler; BLK Law Group

(57) ABSTRACT

A dowel basket includes a metal frame with a plurality of non-metallic dowel bars having weld members secured to the dowel bars and welded to the metal frame. The dowel basket may provide wherein the weld members include weldable metal though pins extending through through-holes provided on opposed ends of each dowel bar and welded to loop wires of the metal frame, or weldable metal caps on opposed ends of each dowel bar welded to the metal frame, or weldable metal caps with at least one lug on opposed ends of each dowel bar welded to the metal frame. A method of forming a dowel basket including a metal frame with a plurality of non-metallic dowel bars comprises the steps of securing weld members to opposed ends of each of the dowel bars and welding each of the dowel bars to the metal frame via the weld members.

17 Claims, 3 Drawing Sheets

(56) References Cited

U.S. PATENT DOCUMENTS

| | | | | | |
|---|---|---|---|---|---|
| 3,279,335 | A * | 10/1966 | Garner | E01C 11/14 | 404/62 |
| 3,397,626 | A | 8/1968 | Kornick | | |
| 5,870,869 | A * | 2/1999 | Schrader | E01C 11/14 | 52/396.02 |
| 6,019,546 | A | 2/2000 | Ruiz | | |
| 6,092,960 | A | 7/2000 | McCallion | | |
| 6,171,016 | B1 * | 1/2001 | Pauls | E01C 11/14 | 404/59 |
| 6,447,203 | B1 | 9/2002 | Ruiz et al. | | |
| 7,441,984 | B2 * | 10/2008 | Kramer | E01C 11/14 | 404/52 |
| 7,632,037 | B2 * | 12/2009 | Brinkman | E01C 11/14 | 404/58 |
| 8,511,935 | B1 | 8/2013 | Thomas | | |

* cited by examiner

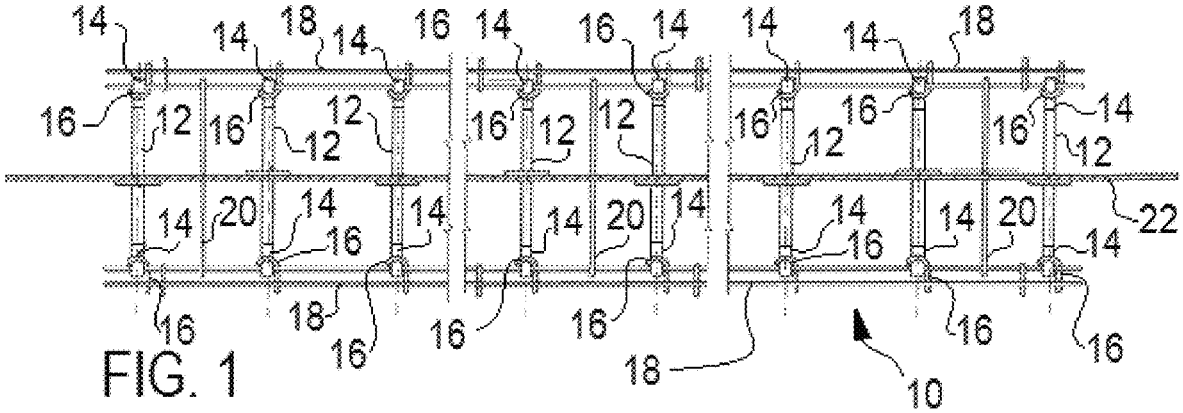
FIG. 1
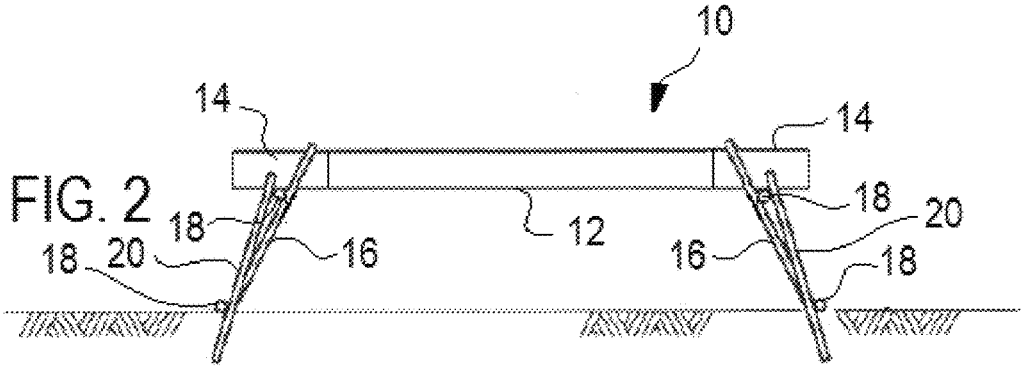
FIG. 2
FIG. 3
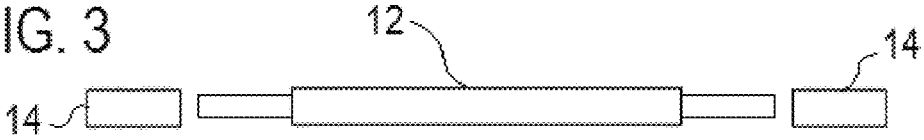
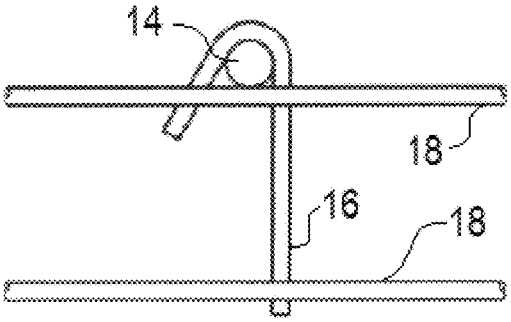
FIG. 4
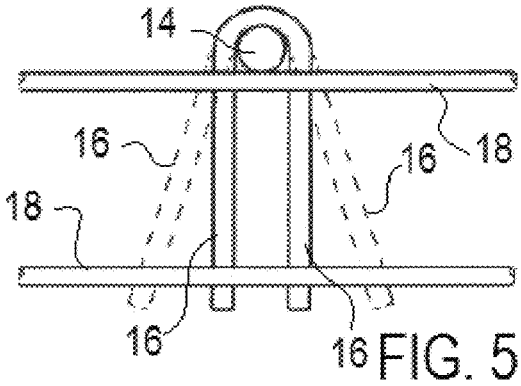
FIG. 5

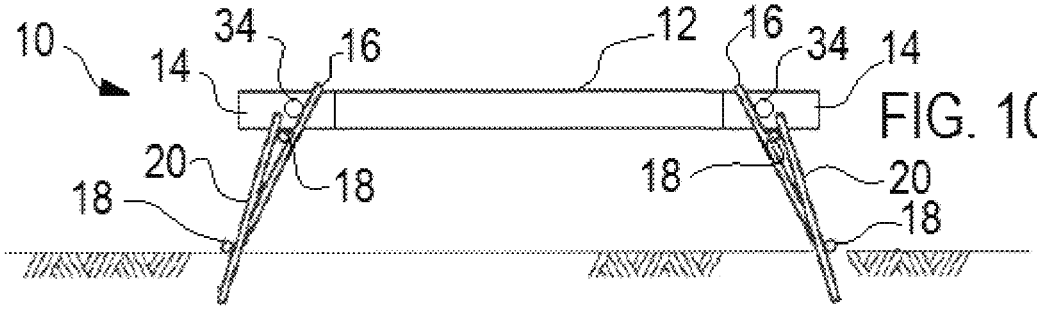
FIG. 10
FIG. 11
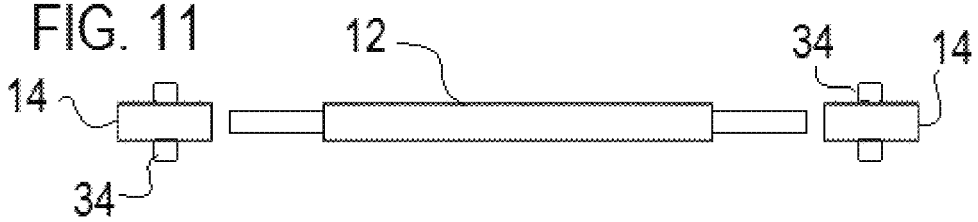
FIG. 12
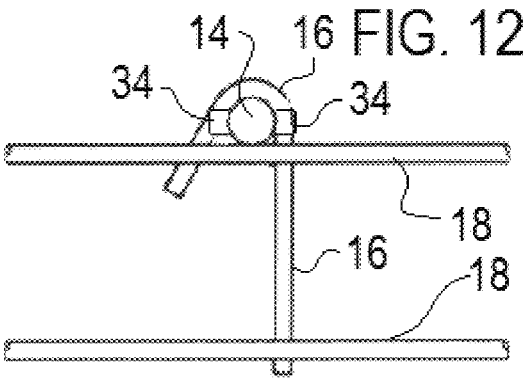
FIG. 13
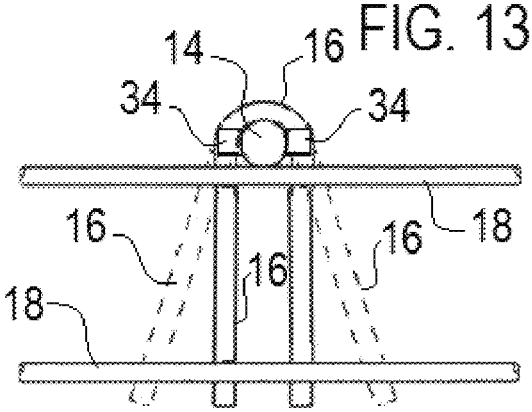

DOWEL BASKET WITH NON-METALLIC DOWEL BARS AND METHOD OF MAKING SAME

RELATED APPLICATIONS

The present application claims the benefit of U.S. Provisional Patent Application Ser. No. 62/789,859 filed Jan. 8, 2019 titled "Dowel Basket with Non-Metallic Dowel Bars and Method of Making Same" which is incorporated herein by reference.

BACKGROUND OF THE INVENTION

1. Field of the Invention

This invention generally relates to non-metallic paving dowels, such as fiberglass, coupled to a steel dowel basket frame.

2. Background Information

In concrete construction such as highways and runways, joints are purposefully placed discontinuities in a rigid concrete surface course also known as pavement. Joints can be formed in two ways. Contraction joints are most often sawed in after concrete placement. Others such as expansion, isolation and construction joints, are created by formwork before the concrete slab is placed. Each one of these types of joint construction has its own method and set of considerations. For example, a construction joint is a joint between slabs that results when the concrete slabs are placed at different times. This type of joint can be further broken down into transverse and longitudinal construction joints.

In concrete construction dowel bars, sometimes referenced as dowels, are short bars that provide a mechanical connection between adjacent concrete slabs without restricting horizontal joint movement. Dowel bars increase load transfer efficiency by allowing the adjacent slab to assume some of the load before the load is actually over it. This reduces joint deflection and stress in the approach and leave slabs. Dowel bars are the most common form of load transfer in concrete pavements. Dowel bars come in various sizes, shapes, and materials, but to perform optimally over the course of the pavement life, they need to be oriented appropriately and within tolerable location limits in the concrete slabs. Proper dowel bar placement ensures optimal load transfer with minimal added stress to the pavement. For this reason, attention to dowel bar placement during paving is critical, and ensuring that dowel bar placement accuracy is maintained through paving is a necessary quality control activity.

Dowel baskets, also known as basket frames or paving baskets, have been developed to properly position and maintain dowel bars in position prior to the pour of a slab of concrete. Maintaining the dowel bar in the desired location, is the critical function of the dowel basket and some jurisdiction require that the dowel baskets maintain the dowel bar in a position that does not vary by more than ¼" in the paving process.

U.S. Pat. No. 8,511,935 which is incorporated herein by reference, teaches a dowel basket that is reinforced to maintain dowel bar position in installation. See also U.S. Pat. Nos. 6,447,203; 6,019,546; 3,397,626, 3,114,221, 3,059,553, 3,045,564, 3,033,087, 2,829,572, 2,768,562, 2,627,793 and 2,552,365 which are incorporated herein by reference. In conventional dowel basket construction with steel dowel bars, the bars are welded to loop wires of the basket frame to secure them into position.

Fiberglass dowel bars and fiber composite dowel bars have been used to replace the steel dowel bars. High strength plastic dowel bars have also been proposed, although not significantly commercialized. Fiberglass dowel bar, fiber composite and plastic are much less susceptible to corrosion than the steel counterparts and, thus, they do not require coatings, and often have significant performance advantages, however they are not amenable to welding to the steel dowel basket frames.

There have been a number of attempts to secure fiberglass dowel bars (and similar non-weld-able dowel bars) to steel baskets using spring clips and plastic tie devices. All of the known methods, however, have drawbacks. For example, they often do not grip the fiberglass dowel bars securely and they tend be become loose and misaligned.

U.S. Pat. No. 6,092,960, which is incorporated herein by reference, teaches a paving basket with a closed clip including a cylinder with an end aperture for receiving one end of the dowel and a snap-on connection for connecting the open clip to the basket, and further includes an open clip for receiving the other end of the dowel in a snap-on connection to the basket. The system of the '960 patent beneficially permits fiberglass, fiber composite, reinforced plastic, or other non-metallic dowel bars to be supported in the dowel basket frame, but does not sufficiently prevent horizontal dowel bar movement. The solution of the '960 patent raised cost concerns as well and was not widely adopted.

There remains a need in the art to permits fiberglass, fiber composite, reinforced plastic, or other non-metallic dowel bars to be supported in the dowel basket frame in a cost effective, efficient and effective manner.

SUMMARY OF THE INVENTION

The various embodiments and examples of the present invention as presented herein are understood to be illustrative of the present invention and not restrictive thereof and are non-limiting with respect to the scope of the invention.

The present invention provides a dowel basket including a metal frame with a plurality of non-metallic dowel bars having weld members secured to the dowel bars and welded to the metal frame. The dowel basket according to one aspect of the invention may provide wherein the weld members include weldable metal though pins extending through through-holes provided on opposed ends of each dowel bar and welded to loop wires of the metal frame. The dowel basket according to one aspect of the invention may provide wherein the weld members include weldable metal caps on opposed ends of each dowel bar welded to the metal frame. The dowel basket according to one aspect of the invention may provide wherein the weld members include weldable metal caps with at least one lug on opposed ends of each dowel bar welded to the metal frame.

The present invention provides a method of forming a dowel basket including a metal frame with a plurality of non-metallic dowel bars comprises the steps of securing weld members to opposed ends of each of the dowel bars and welding each of the dowel bars to the metal frame via the weld members These and other advantages of the present invention will be clarified in the description of the preferred embodiments taken together with the attached figures.

BRIEF DESCRIPTION OF THE DRAWINGS

FIG. 1 is a schematic top plan view of a dowel basket with non-metallic dowel bars having weld members secured thereto in accordance with a first embodiment of the present invention;

FIG. 2 is a schematic front elevation view of the dowel basket with non-metallic dowel bars of FIG. 1;

FIG. 3 is a schematic front elevation exploded view a non-metallic dowel bar of FIG. 1;

FIG. 4 is a schematic side elevation view of a portion of the dowel basket with non-metallic dowel bars of FIG. 1;

FIG. 5 is a schematic side elevation view of a portion of a modified dowel basket with non-metallic dowel bars of FIG. 1;

FIG. 10 is a schematic front elevation view of a dowel basket with non-metallic dowel bars having weld members secured thereto in accordance with a third embodiment of the present invention;

FIG. 11 is a schematic front elevation exploded view a non-metallic dowel bar of FIG. 10;

FIG. 12 is a schematic side elevation view of a portion of a modified dowel basket with non-metallic dowel bars of FIG. 10; and FIG. 13 is a schematic side elevation view of a portion of a modified dowel basket with non-metallic dowel bars of FIG. 10.

DESCRIPTION OF THE PREFERRED EMBODIMENTS

Figure 6:
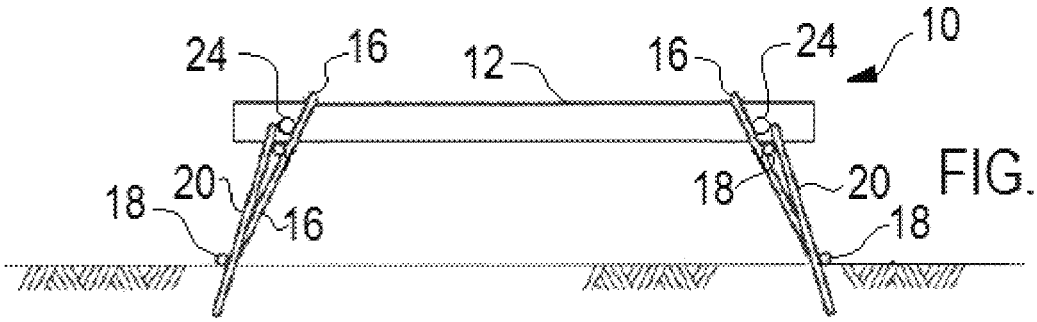
FIG. 6 is a schematic front elevation view of a dowel basket with non-metallic dowel bars having weld members secured thereto in accordance with a second embodiment of the present invention.

The present invention provides a dowel basket 10 with non-metallic dowel bars 12 having weld members secured thereto, such as steel endcaps 14 shown in FIGS. 3-5, through weld pin 24 shown in FIGS. 6-9 or cap 14 with weld lugs 34 shown in FIGS. 10-13. The weld members allow for welding of the non-metallic dowel bars 12 to the loop wires 16 and/or rail wires 18 of the basket 10 to secure the dowel bars in place.

The non-metallic dowel bar 12 is preferably a fiberglass dowel bar 12, but may be a reinforced composite, a reinforced plastic or any non-weld-able material.

The present invention utilizes a standard wire metal frame for the basket 10 and it is noteworthy that the National Concrete Consortium has had a goal for more than a decade of standardizing basket frame designs. The basket 10 of the invention preferably conforms to these recommendations:

The basket 10 includes loop wires 16, in a J, U or V style, extending between the upper rail wire 18 and the lower rail wire 18 at each dowel bar 12 location, and the loop wire is generally about 0.243 in. min. diameter. The basket 10 includes longitudinally extending basket rail wire 18, an upper rail wire 18 and lower rail wire 18 on each side, which should be about 0.306 in. min. diameter. Spacer or tie wires 20, as needed, are used in the basket structure 20 and should be about 0.177 in. dia. (7 gauge). The FIG. 1 also show a conventional expansion joint filler 22 for context but this is not part of the invention.

The first embodiment of the present invention is shown in FIGS. 1-5 and provides weldable metal caps 14, preferably a steel caps 14 on opposed ends of the dowel bar 12 and secured thereto by adhesive, friction fit, swedging, or the like. The weldable caps 14 are received within the metal frame of the dowel basket and can be welded in position by tack welding to the loop wires 16 and/or to the upper rail wire 18.

FIG. 3 shows a "step down" at the ends of the dowel 12 receiving the caps 14 so that the outer perimeter of the caps 14 aligns with the portion of the dowel 12 between the caps 14 whereby the dowel 12 with caps 14 presents a uniform thickness (as does a conventional dowel bar). The caps 14 will have an outer diameter that is determined by the associated frame, namely the loop wires 16, to accommodate welding. The caps 14 need only extend far enough along the bar 12 to allow for tack welding to the to the loop wires 16 and/or to the upper rail wire 18. The diameter of the dowel bar 12 is determined by the associated strength needed for the dowel bar 12 in operation across the joint.

It may be more cost effective if the caps 14 are fit onto corresponding dowel bars 12 that are uniform outer diameters (no step down as shown), however the embodiment shown may yield advantages for automating the assembly process (because the equipment does not need to accommodate the stepdown as shown).

FIG. 4 shows the first embodiment used with J shaped loop wires 16, while FIG. 5 shows the first embodiment is easily utilized with U or A shaped loop wires 16.

The second embodiment of the present invention is shown in FIGS. 6-9 and provides weldable metal though pins 24, preferably a steel pins 24 extending through through-holes provided on opposed ends of the dowel bar 12 and secured thereto by adhesive or a friction fit. The weldable metal though pins 24 are received on the metal frame of the dowel basket 10 adjacent the loop wires 16 and can be welded in position by tack welding to the loop wires 16.

In assembly, the dowel bar 12 with predrilled holes for the pins 24 is preferably placed on the frame of the basket 10, the holes aligned to be horizontal, and then the through pins 24 placed through horizontal holes to lock the dowel bar 12 in place with the dowel bar 12 further secured by welding each pin 24 to the associated loop wire 16.

Figure 7:
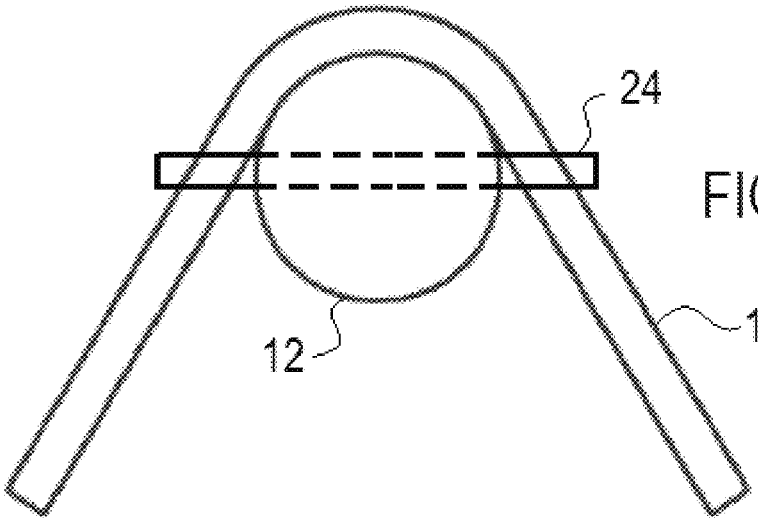
FIG. 7 is a schematic side elevation view of a portion of the dowel basket with non-metallic dowel bars of FIG. 6.
Figure 8:
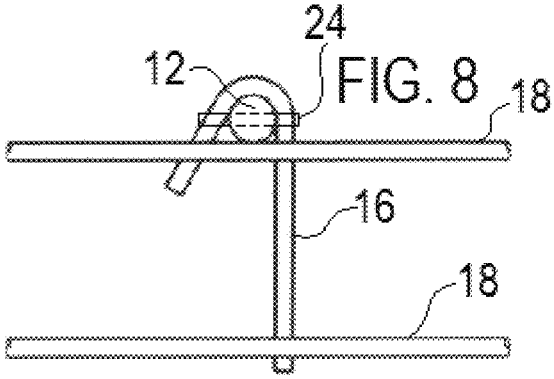
FIG. 8 is a schematic side elevation view of a portion of a modified dowel basket with non-metallic dowel bars of FIG. 6.
Figure 9:
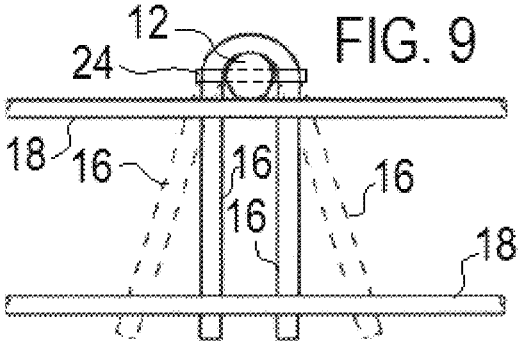
FIG. 9 is a schematic side elevation view of a portion of a modified dowel basket with non-metallic dowel bars of FIG. 6.

FIG. 7 shows the second embodiment used with A shaped loop wires 16, FIG. 8 shows the second embodiment used with J shaped loop wires 16, and FIG. 9 shows the second embodiment is easily utilized with U (or A in phantom) shaped loop wires 16.

The third embodiment of the present invention is shown in FIGS. 10-13 and provides weldable metal caps 14 with weld lugs 34, preferably a steel caps 14 and steel lugs 34 on opposed ends of the dowel bar 12 and secured thereto by adhesive, friction fit, swedging, or the like. The weldable caps 14 with weld lugs 34 are received within the metal frame of the dowel basket and can be welded in position by tack welding to the loop wires 16 and/or to the upper rail wire 18. The weld lugs 34, like locking pins 24, provide a welding location, if desired, and can further secure the dowel 12 in position in assembly.

The dowel bar 12 may be sized to have an outer diameter match the outer diameter of the cap 14 as shown, or may be uniform in diameter. In this embodiment it is likely the dowel bar 12 in practice would be of uniform diameter throughout. The weld lugs 34 must accommodate the assembly process and thus may extend less distance from the outer diameter of the dowel bar 12 than the locking pin 24, because the lugs 34 will typically be in position while the dowel bar 12 is being placed into position. Additionally the lug 34 may only be on one side of the cap 14 to better accommodate assembly.

All three embodiments of the present invention permits fiberglass, fiber composite, reinforced plastic, or other non-metallic dowel bars 12 to be supported in the dowel basket frame 10 and welded in position in a cost effective, efficient and effective manner While this invention has been particularly shown and described with references to the preferred embodiments thereof, it will be understood by those skilled in the art that various changes in form and details may be made therein without departing from the scope of the invention.

What is claimed is:

1. A dowel basket including a metal frame with a plurality of non-metallic dowel bars having weld members secured to the dowel bars and welded to the metal frame, wherein the weld members include weldable metal through pins extending through through-holes provided on opposed ends of each dowel bar and welded to loop wires of the metal frame, wherein the dowel bars have a longitudinal axis and wherein the through-holes extend perpendicular to the longitudinal axis of the dowel bar and entirely through the dowel bar.

2. The dowel basket according to claim 1 wherein each non-metallic dowel bar is formed of fiberglass, reinforced composite, or reinforced plastic.

3. The dowel basket according to claim 2 wherein the metal through pins are formed as cylindrical steel pins.

4. The dowel basket according to claim 3 wherein each cylindrical steel pin extends through the through-hole extending out an equal distance from opposite sides of the dowel bar.

5. The dowel basket according to claim 4 wherein each cylindrical steel pin is adhesively secured to the dowel bar.

6. The dowel basket according to claim 1 wherein the metal through pins are formed as cylindrical steel pins.

7. The dowel basket according to claim 6 wherein each cylindrical steel pin extends through the through-hole extending out an equal distance from opposite sides of the dowel bar.

8. The dowel basket according to claim 7 wherein each cylindrical steel pin is adhesively secured to the dowel bar.

9. The dowel basket according to claim 1 wherein each non-metallic dowel bar is formed of fiberglass.

10. The dowel basket according to claim 9 wherein the metal through pins are formed as cylindrical steel pins.

11. The dowel basket according to claim 10 wherein each cylindrical steel pin extends through the through-hole extending out an equal distance from opposite sides of the dowel bar.

12. The dowel basket according to claim 11 wherein each cylindrical steel pin is adhesively secured to the dowel bar.

13. A dowel basket including a metal frame with a plurality of fiberglass dowel bars having weld members secured to the dowel bars and welded to the metal frame, wherein the weld members include weldable metal caps with at least one lug on opposed ends of each dowel bar welded to the metal frame, wherein each weldable metal cap includes a pair of radially extending lugs on opposed sides of the cap, and wherein each weldable metal cap includes a pair of radially extending lugs on opposed sides of the cap.

14. A method of making a dowel basket including a metal frame with a plurality of non-metallic dowel bars comprises the steps of securing weld members to opposed ends of each of the dowel bars and welding each of the dowel bars to the metal frame via the weld members, wherein the weld members include weldable metal through pins extending through through-holes provided on opposed ends of each dowel bar and welded to loop wires of the metal frame, wherein the dowel bars have a longitudinal axis and wherein the through-holes extend perpendicular to the longitudinal axis of the dowel bar and entirely through the dowel bar.

15. The method of making a dowel basket according to claim 14 wherein the metal through pins are formed as cylindrical steel pins.

16. The method of making a dowel basket according to claim 15 wherein each cylindrical steel pin extends through the through-hole extending out an equal distance from opposite sides of the dowel bar.

17. The method of making a dowel basket according to claim 16 wherein each cylindrical steel pin is adhesively secured to the dowel bar.

* * * * *